US005498146A

United States Patent [19]

Ritter et al.

[11] Patent Number: 5,498,146

[45] Date of Patent: Mar. 12, 1996

[54] APPARATUS FOR MAKING METAL ALLOY FOILS

[75] Inventors: Ann M. Ritter, Albany; Paul L. Dupree, Scotia; Donald N. Wemple, Jr., Schenectady, all of N.Y.

[73] Assignee: General Electric Company, Schenectady, N.Y.

[21] Appl. No.: 223,347

[22] Filed: Apr. 5, 1994

[51] Int. Cl.[6] ..... B22F 3/00

[52] U.S. Cl. ..... 425/78; 425/89; 425/405.1; 425/405.2

[58] Field of Search ..... 425/78, 89, 405.1, 425/405.2, 406

[56] References Cited

U.S. PATENT DOCUMENTS

| | | | |
|---|---|---|---|
| 2,943,933 | 7/1960 | Lenhart | 425/78 |
| 3,051,567 | 8/1962 | Ziegler | 425/78 |
| 3,557,414 | 1/1971 | Alliegro | 425/89 |
| 3,743,455 | 7/1973 | Green | 425/78 |
| 3,861,839 | 1/1975 | Malik | 425/405.1 |
| 4,008,023 | 2/1977 | Wentzell | 425/78 |
| 4,142,888 | 3/1979 | Rozmus | 425/405.2 |
| 4,917,858 | 4/1990 | Eylon et al. . | |

FOREIGN PATENT DOCUMENTS

| | | | |
|---|---|---|---|
| 0392818 | 10/1990 | European Pat. Off. | 425/405.2 |
| 256691 | 12/1911 | Germany | 425/89 |
| 62-46604 | 2/1987 | Japan | 425/89 |

OTHER PUBLICATIONS

"News at a Glance"; Advanced Materials & Processes; Feb, 1992; p. 9; COL. 1,2.

"Processing and Properties of Gamma Titanium Aluminide Sheet from PREP Powder"; Powder Metallurgy in Aerospace & Defense Technologies; M. A. Ohls, W. T. Nachtrab and P. R. Roberts; 1991; pp. 289–296.

*Primary Examiner*—C. Scott Bushey

*Attorney, Agent, or Firm*—Edmund P. Anderson; James E. Magee, Jr.

[57] ABSTRACT

An apparatus for use in hot pressing metal alloy foils, such as by HIP, directly from metal alloy powders. The invention is a metal container with a cavity having near-net shape of a thin metal foil. The cavity may be lined with a diffusion inhibiting material, so as to inhibit the interdiffusion between the metal container and the metal alloy powder during hot pressing. The apparatus also may include an integrally formed orifice for evacuating the metal container.

20 Claims, 4 Drawing Sheets

APPARATUS FOR MAKING METAL ALLOY FOILS

CROSS-RELATED TO RELATED

APPLICATIONS

The subject application is related to U.S. Pat. applications Ser. No.08/223,345, filed Apr. 5, 1994, now U.S. Pat. No. 5,427,736 and Ser. No. 08/194,967, filed Feb. 14, 1994, now U.S. Pat. No. 5,427,735; which are herein incorporated by reference.

1. Field of the Invention

The present invention is an apparatus for making metal alloy foils by hot pressing metal alloy powders. More specifically, the apparatus of the present invention may be used to make metal foils of moderate to high melting point metal alloys, such as Ti-base, Ni-base and Nb-base alloys, as well as Al-Si alloys, by hot isostatic pressing (HIP) of pre-alloyed powders of these materials.

2. Background of the Invention

Hot pressing of metal alloy powders, in particular hot isostatic pressing (HIP), is a maturing technology which is used to make a wide variety of metal components and frequently incorporates the use of a metal container or can to hold the metal powder of interest.

A wide variety of metal containers have been developed for use in the HIP process, including metal containers used to make metal sheets and plates as described in Processing and Properties of Gamma Titanium Aluminide Sheet produced from PREP Powder, M. A. Ohls, W. T. Nachtrab and P. R. Roberts, Powder Metallurgy in Aerospace and Defense Technologies, 1991, pp. 289–296. However, such containers do not combine the necessary elements required to produce metal alloy foils using HIP or similar hot pressing processes, in part, because they do not address problems associated with loading powder in a thin, foil-shaped space or removing a completed metal foil from such a space.

Also, a process utilizing pure metal powders has been used, as described in U.S. Pat. 4,917,858, to make metal alloy foils, but no specialized HIP apparatus is described for performing the process.

A foil is defined in A Concise Encyclopedia of Metallurgy, by A. D. Merriman, MacDonald and Evans LTD. 1965 as a very thin sheet of metal with no standard thickness, but in general usage is regarded as being intermediate in thickness between "leaf" and "sheet" materials. A Glossary of Metallurgical Terms and Engineering Tables, published by The American Society for Metals in 1983 defines a foil as "a metal in sheet form less than 0.15 mm (0.006 inches) in thickness." As used herein, the term "foil" designates a thin layer of metal having a thickness range of about 0.005–0.017 inches in the as-hot-pressed condition, as further described in co-pending patent application Ser. No. 08-223,345, filed Apr. 5, 1994, now U.S. Pat. No. 5,427,736 referenced above, except that thicker sheets of material should be included within this definition to the extent that the method of making described herein can be utilized to produce ductile forms of alloys such that they may be formed to a thickness within the range described above and likewise thinner foils should be included within this definition to the extent that they are subsequently formed from foils initially falling within this range.

Summary of the Invention

The apparatus of the present invention comprises a metal container or can which defines a foil-shaped cavity that may be filled with a metal alloy powder and compressed by hot pressing to form a metal foil directly from such powder. This apparatus contains special features such as an internal cavity which defines a near-net shape of a foil, particularly the critical thickness dimension of a foil as defined above. As used herein, a cavity having a "near-net shape of a foil" simply means that the thickness of the cavity is such that when filled with metal alloy powders, it may be hot pressed to directly produce a metal alloy foil having a thickness in the range defined herein. Given that powder packing density varies depending on the powder particle size, shape, distribution and other factors, as well as the method of loading, this near-net foil shape/thickness is about 0.010–0.040 inches.

Another feature of this invention is a means for inhibiting interdiffusion between the metal container and the metal alloy powder which may be easily incorporated into the container, and which also may be utilized to enhance the uniformity of the thickness of the resultant metal foils.

The apparatus comprises: means for pressing a metal alloy powder, comprising an upper pressing member and a lower pressing member, each having a pressing surface, said pressing surfaces positioned opposite one another; means for separating in touching contact with the pressing surfaces, said means for separating and the pressing surfaces together defining a cavity having a near-net shape of a foil; and means for sealably joining said means for pressing and said means for separating.

The apparatus also may comprise a means for evacuating the cavity.

The apparatus also may comprise a means for inhibiting interdiffusion attached to the pressing surfaces.

One object of the present invention is to provide an apparatus that permits the direct manufacture of metal foils from metal alloy powders, as contrasted with prior art methods of foil manufacture which typically require numerous forming, rolling, annealing, and surface finishing operations.

A second object of the present invention is to provide an apparatus which may be evacuated prior to and during hot pressing to permit the manufacture of foils of highly reactive metals, particularly those that are reactive with nitrogen and oxygen and other atmospheric constituents.

Another object of this invention is to provide an apparatus which inhibits interdiffusion between a metal alloy powder and the apparatus.

This apparatus is particularly advantageous because it enables a method of making metal alloy foils which avoids costly limitations related to related art methods of forming metal foils, including limitations due to costly forming, heat treating and surface finishing operations.

Other objects, features and advantages of the present invention will be apparent to those of ordinary skill from other portions of this application, particularly, the detailed description of the invention set forth below.

DETAILED DESCRIPTION OF THE INVENTION

Figure 1:
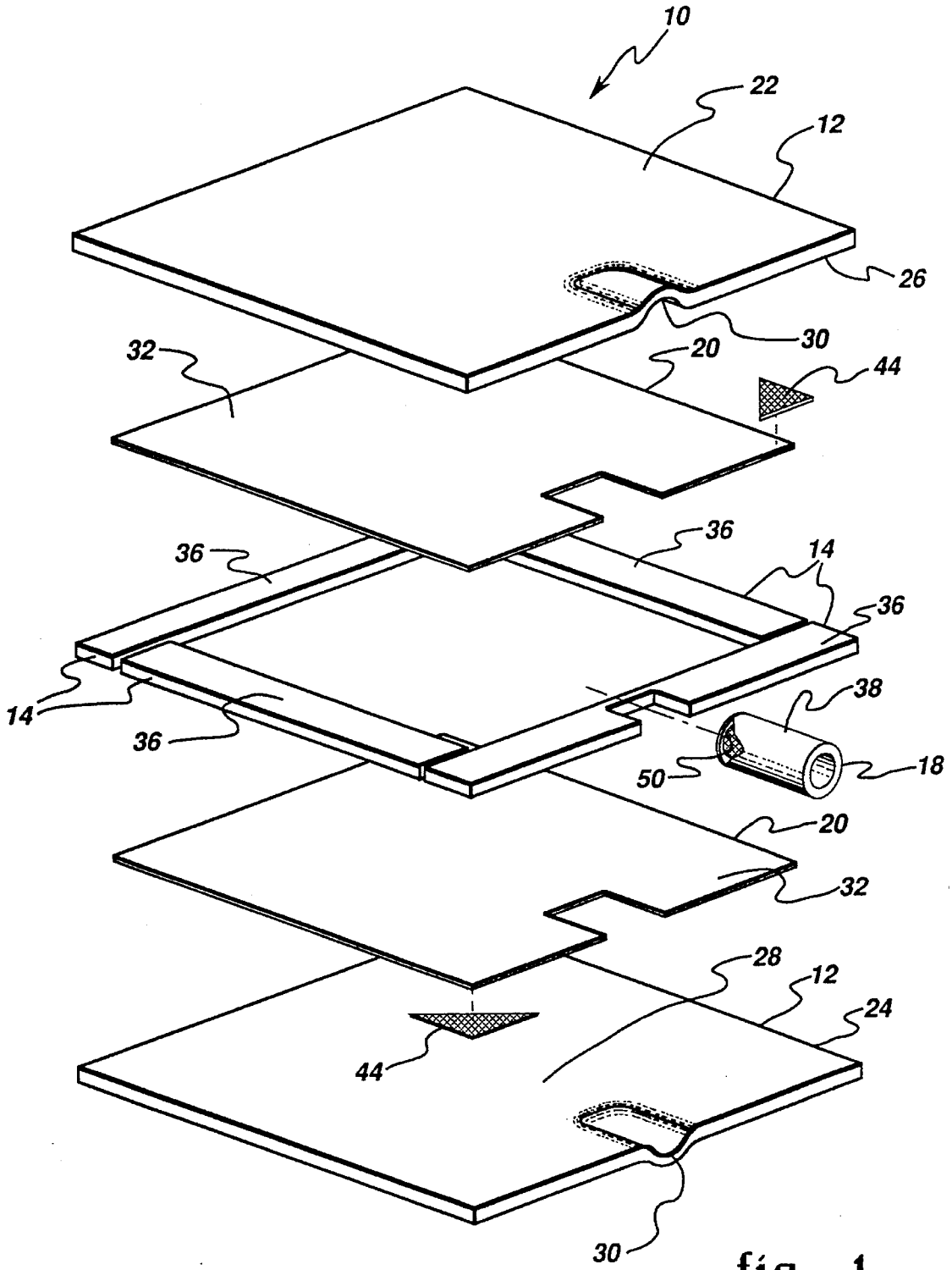
FIG. 1 is an exploded isometric view of the elements of the present invention.

The present invention is an apparatus for making metal alloy foils directly from metal alloy powders. Referring now to FIG. 1, Apparatus 10 comprises a means for pressing 12, means for separating 14, means for sealably joining 16 and means for evacuating 18. In a preferred embodiment, apparatus 10 also comprises a means for inhibiting interdiffusion 20.

Figure 4:
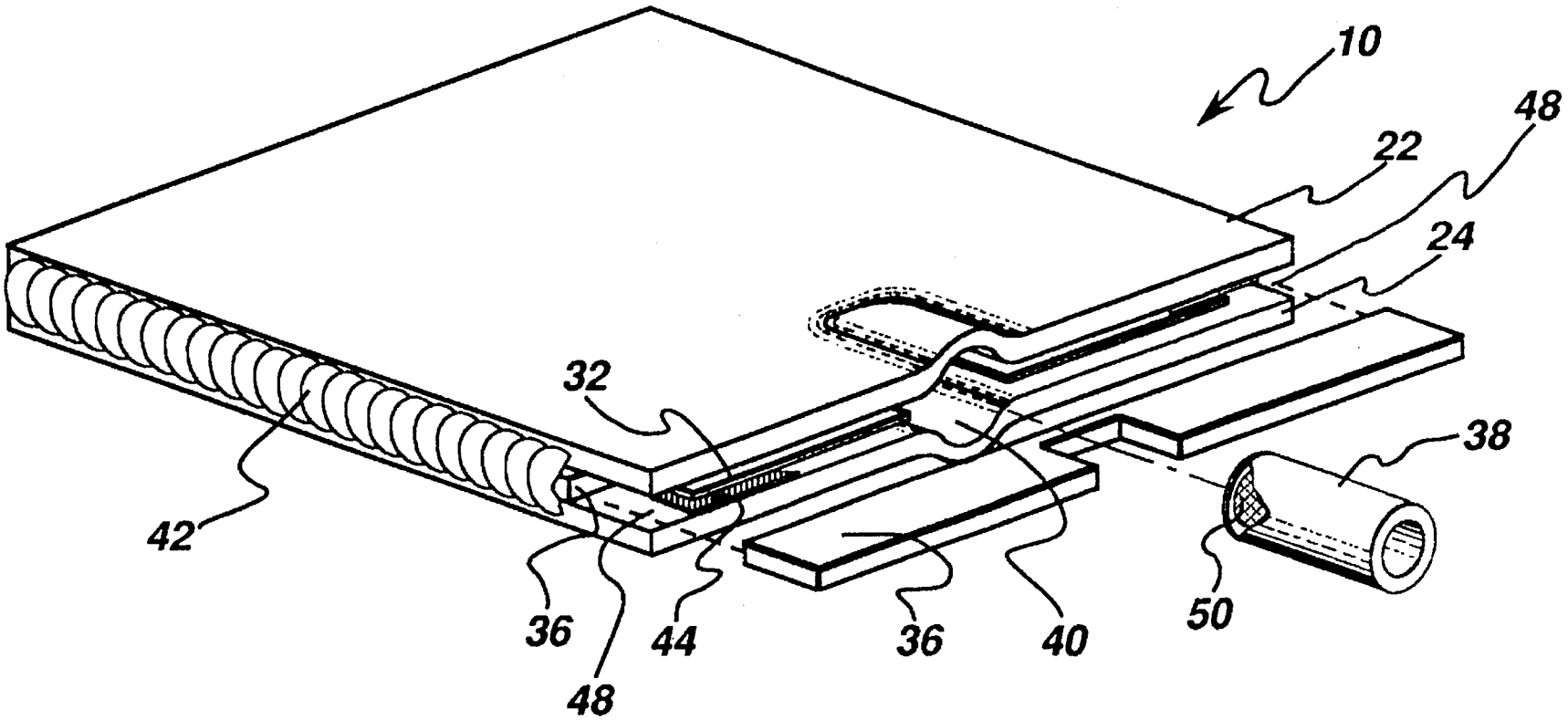
FIG. 4 is a perspective view of a partially assembled apparatus with several exploded elements which illustrate how the apparatus is assembled.

In a preferred embodiment, a means for pressing 12, comprises an upper platen 22 and a lower platen 24. The upper and lower designations given to these platens do not depict a necessary spatial relationship, but are used herein only for the purpose of distinguishing these elements. While upper platen 22 and lower platen 24 may be of any shape, including complex shapes, in a preferred embodiment, they comprised flat rectangular plates made from cold-rolled steel. Both platens include a pressing surface, illustrated in FIG. 1 as upper pressing surface 26 and lower pressing surface 28. Upper pressing surface 26 and lower pressing surface 28 are chosen such that when apparatus 10 is assembled, that these surfaces are opposing surfaces. In a preferred embodiment, upper pressing surface 26 and lower pressing surface 28 are complementary, or negative mirror-images of one another, with respect to their size and shape, such that if placed together that these surfaces would generally conform to one another. This is the case so that they will generally produce metal foils having a uniform size and thickness. However, combinations of these elements, so as to produce non-uniform thicknesses in the resulting foil may be desirable for some applications. For example, it would be possible to design upper pressing surface 26 and lower pressing surface 28 so as to produce a component where only a portion of the component is a metal foil, insofar as thickness is concerned. Means for pressing 12 also may include a portion of means for evacuating 18. In a preferred embodiment, part of means for evacuating 18 comprises a hemi-cylindrical formed region 30 on an edge of upper pressing surface 26 and lower pressing surface 28. Hemi-cylindrical formed regions 30 are located such that when upper pressing surface 26 and lower pressing surface 28 are arranged in their opposed position, that hemi-cylindrical formed regions 30 are adjacent to and opposed from one another forming cylindrical orifice 40, as shown in FIG. 4 and described further below.

Figure 2:
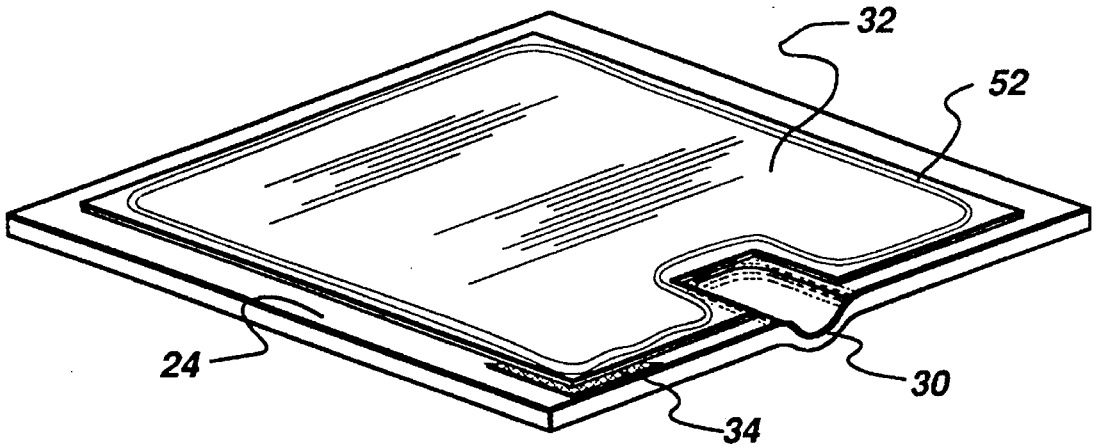
FIG. 2 is a perspective view illustrating the assembly of several of the elements of the present invention.

Referring again to FIG. 1, in a preferred embodiment means for inhibiting interdiffusion 20 comprises metal foils 32. In a preferred embodiment, where metal alloy powders used include Ti-base, Ni-base, Nb-base and Al-Si alloys, metal foils 32 are made from molybdenum foil having a thickness of approximately 0.001 in. In a preferred embodiment, metal foils 32 are attached to upper metal platen 26 and lower metal platen 28 by means of a rub-weld 52 around their circumference made using a bare copper electrode, as shown in FIG. 2. Applicants also believe that means for inhibiting interdiffusion could also comprise a diffusion barrier coating applied directly to means for pressing 12, and particularly to the pressing surfaces thereof. Such coatings could include various metal or ceramic coatings, or combinations thereof, so long as the coating serves to inhibit diffusion between the metal alloy powder to be used and the material from which means for pressing 12 is constructed. In a different embodiment, means for inhibiting interdiffusion 20 can be made using two sheets of metal foil 32 on each platen, with a coating of magnesium hydroxide between the sheets. Such a configuration can be utilized to more easily de-bond the resultant metal alloy foil from the HIP can, such as when it is particularly susceptible to the etchant used to remove apparatus 10. The magnesium hydroxide serves as a de-bonding agent to further assist in the removal of apparatus 10.

Figure 3:
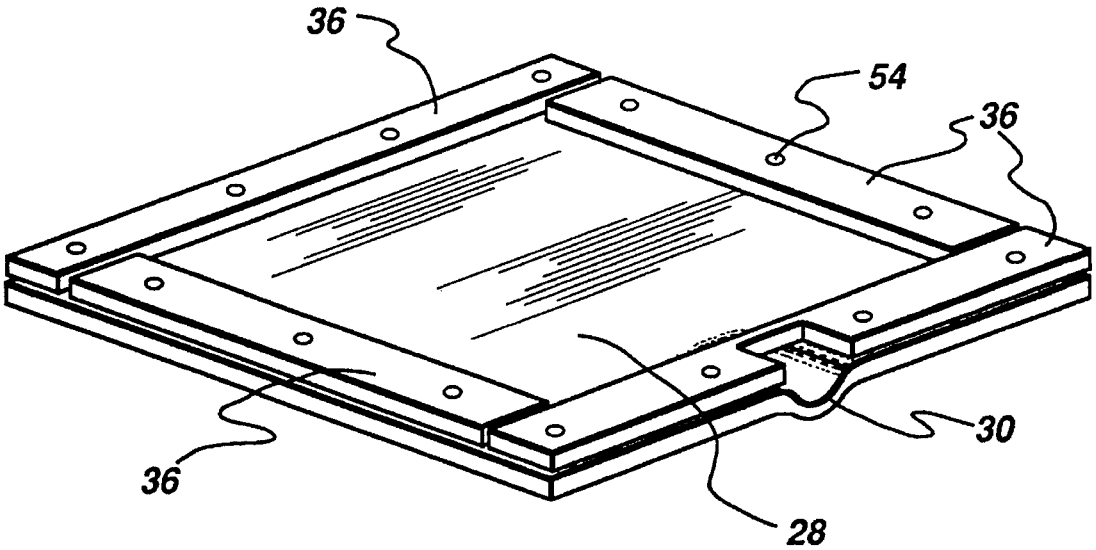
FIG. 3 is a perspective view of the elements of FIG. 2 illustrating the assembly of several additional elements.

Referring again to FIG. 2, in a preferred embodiment, metal screens 34 made from fine-meshed stainless steel screen, having a mesh size smaller than the smallest powder particles to be used, are incorporated in conjunction with metal foils 32. In a preferred embodiment, metal screen 34 is a stainless steel cloth having about 660 wires/inch. The function of metal screens 34 is to provide a means by which air which is normally entrapped behind metal foils 32 may be removed in conjunction with the evacuation of apparatus 10, as described more fully below; while at the same time preventing powder particles from becoming lodged behind metal foils 32. Metal screens 34 are rub-welded in place along with metal foils 32. Rub-welds 52 serve to attach metal foils 32 and metal screens 34, while the mesh in the screens provides an air passageway underneath rub-weld 52. It should be noted that while FIGS. 2 and 3 represent the assembly of metal foil 32 to lower platen 24, over pressing surface 28, that a metal foil 32 is attached in like manner to upper platen 22, over upper pressing surface 26.

Figure 5:
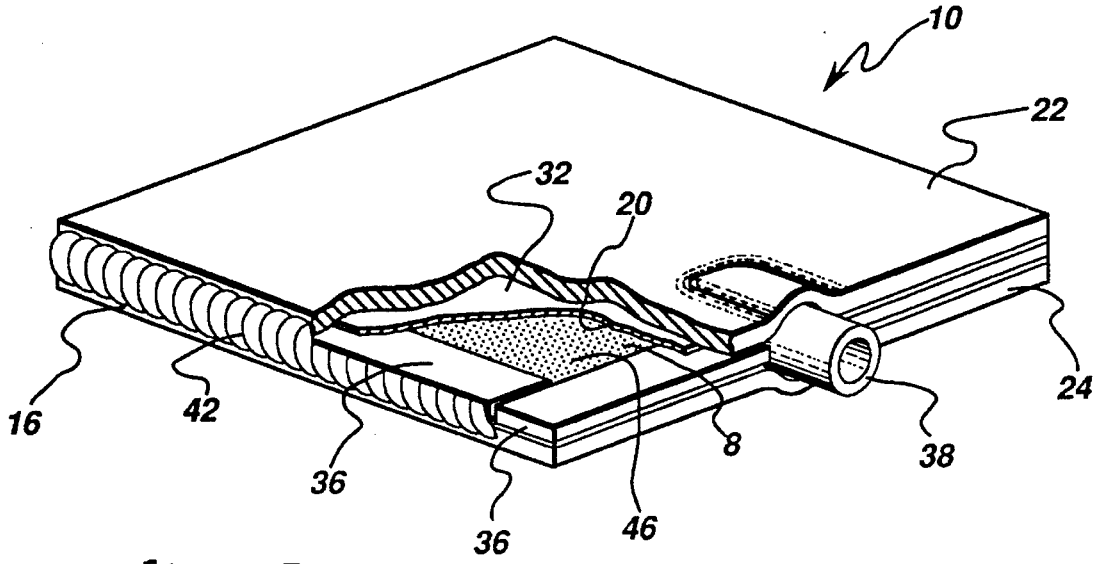
FIG. 5 is a view of the apparatus of FIG. 2 illustrating how the exploded elements of FIG. 2 are assembled into the apparatus.

In a preferred embodiment, means for separating 14 comprise a shim or a series of shims 36. As shown in FIG. 3, in a preferred embodiment, shims 36 comprise four rectangular, flat, cold-rolled steel sheets. As shown in FIG. 3, in a preferred embodiment, shims 36 are placed around the periphery of lower platen 24, and are held in place by any suitable means, such as spot welds 54. The area encompassed by shims 36 defines lower pressing surface 28. Likewise, although not shown, shims 36 serve to define upper pressing surface 26 on upper platen 22 also. In a preferred embodiment, shims 36 overlap metal foils 32 and thus, directly determine the thickness of the cavity 46, as identified in FIG. 5 (even though it is illustrated as being filled in this figure by metal alloy powder 8), and illustrated indirectly in FIG. 3 (by the thickness of shim 36, even though upper platen 22 is not shown in FIG. 3). However, metal foils 32 may also be designed so as to fall within the area defined by shims 36, without overlap (not shown). In such a configuration, the thickness of cavity 46, as shown in FIG. 5, is the thickness of the shim less the combined thicknesses of metal foils 32. As discussed above, cavity 46 comprises a near-net foil shape, particularly with respect to the cavity thickness dimension, which in a preferred embodiment is about 0.010–0.040 in., but more preferably 0.010–0.020 in., and most preferably about 0.015 in. Referring now to FIG. 4, shim or shims 36 may be notched in the region of orifice 40, so as to accommodate the assembly of means for evacuating 18, such as in a preferred embodiment metal tube 38. It should also be noted that hemi-cylindrical formed regions 30 extend inwardly into cavity 46, and extend beyond the inner edge of shim 36, such that an air passageway exists between orifice 40 and cavity 46.

Referring now to FIGS. 1–4, upper platen 22 having metal foil 32 attached as described herein, is oriented with respect to lower platen 24 and placed upon shim 36 as also described herein. Means for sealably joining 16 in the form of weld 42 is then applied to the three outer edges of upper platen 22, lower platen 24 and shim 36.as shown, leaving only opening 48 on one end of apparatus 10. Opening 48 is what is used to load metal alloy powder 8 into cavity 46, as shown in FIGS. 4 and 5 and described in the referenced co-pending application Ser. No. 08-223,345, filed Apr. 5, 1994, now U.S. Pat. No. 5,427,736. In a preferred embodiment, weld 42 is a tungsten inert gas (TIG) weld.

As shown in FIG. 5, cavity 46 is filled with metal alloy powder 8. The final shim 36 is then inserted into apparatus 10, and means for evacuating 18, such as in a preferred embodiment comprising metal tube 38 is inserted into orifice 40. The remainder of means for sealably joining 16 may then be applied to the outer edges of apparatus 10 and around orifice 40, as described above.

Figure 6:
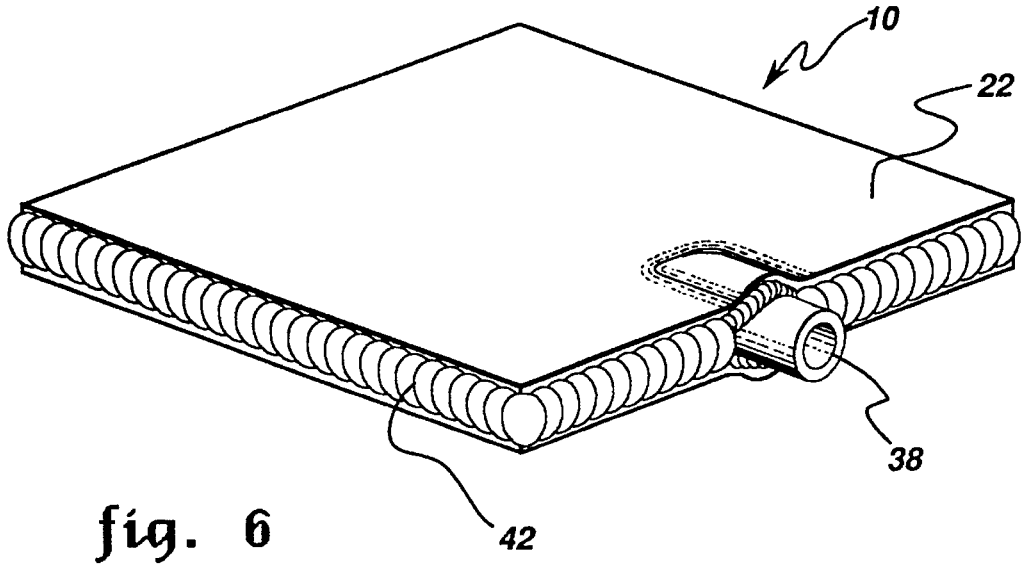
FIG. 6 is a view of an assembled apparatus of the present invention.

Means for evacuating may assume a wide variety of embodiments. In a preferred embodiment, it comprises metal tube 38 which has screen 50 attached to the end which is to be inserted into orifice 40 of apparatus 10. Screen 50 permits a vacuum to be drawn within cavity 46, without causing the removal of powder 8 at the same time FIG. 6 illustrates a completed apparatus 10 which may be processed according to the method described in the referenced co-pending application Ser. No. 08-223,345, filed Apr. 5, 1994, now U.S. Pat. No. 5,427,736, in order to produce a metal alloy foil Example 1

A HIP can consisted of two cold-rolled steel sheets, 1/16" thick, 5" wide, and 7" long. These sheets were each formed at one end to accommodate a 0.25 in. O.D. diameter steel tube which was ultimately used to evacuate the HIP can. To each steel sheet, a 0.001" thick piece of Mo foil 4.5" wide by 6" long was rub-welded (e.g.spot-welded continuously) around the edges, leaving a 0.25 in. gap near the formed portion of the steel. The Mo foil was used to prevent interdiffusion of the powder (e.g. a Ti-base alloy) with the steel sheets during HIP. In a corner of each Mo-foil, a 0.375×0.375 in piece of stainless cloth having 660 wires/inch was inserted. Four pieces of cold-rolled steel shim stock, 0.015 in. thick and 0.5 in. wide was spot-welded onto one of the Mo foil/steel sheet assemblies, to form a border around the sides and bottom of one of the halves of the HIP can.

The two pieces of the HIP can were clamped together such that the shims and Mo foils were on the inside of each can. Two additional steel plates were clamped to the outside of each can to prevent warping during welding and pressure testing. The sides and one end of each can were TIG vacuum-welded together. The HIP cans were then loaded with several Ti-base powders as described in the referenced co-pending application Ser. No. 08-223,345, filed Apr. 5, 1994, now U.S. Pat. No. 5,427,736.

Steel shims 5" long and 0.015" were notched to accommodate the steel tubes, and placed in the top of the HIP can with the notches facing outwardly. Pieces of stainless steel screen, with a mesh size smaller than the powder size, were spot-welded to one end of the steel tubes. These screens prevent the powders from being sucked out of the cans during evacuation. The screened end of the tubes were inserted into the top of the HIP can, and the tubes and ends of the HIP cans were TIG vacuum-welded. The assemblies were evacuated and leak-tested and the retaining steel plates were removed. The cans were baked out under vacuum for 24 hours at 200° C., the steel tubes were then hot crimped, cut off and TIG welded, and the assembly of the HIP cans was complete.

What is claimed is:

1. An apparatus for forming a metal alloy foil, comprising:

means for pressing a metal alloy powder, comprising an upper pressing member and a lower pressing member, each having a pressing surface, said pressing surfaces positioned opposite one another;

means for separating in touching contact with the pressing surfaces, said means for separating and the pressing surfaces together defining a cavity having a near-net shape of a foil;

means for sealably joining said means for pressing and said means for separating;

means for evacuating the cavity, said means integrally formed into the means for pressing; and means for inhibiting interdiffusion attached to and covering the pressing surfaces, said means for inhibiting interdiffusion comprising an upper metal foil and a lower metal foil attached to the pressing surfaces of the upper pressing member and the lower pressing member, respectively.

2. The apparatus of claim 1, wherein the upper metal foil and the lower metal foil are both made from molybdenum.

3. The apparatus of claim 1, wherein the upper metal foil comprises two layers and the lower metal foil comprises two layers.

4. The apparatus of claim 3, wherein the two layers of the upper metal foil and the two layers of the lower metal foil are separated by a de-bonding agent.

5. The apparatus of claim 4, wherein the upper and lower metal foils are made from molybdenum and the de-bonding agent is magnesium hydroxide.

6. The apparatus of claim 1, wherein the means for evacuating comprises a cylindrical orifice formed from two opposing hemi-cylindrical shapes, one each formed on an opposing edge of the upper pressing member and lower pressing member, respectively, and a tube inserted into the cylindrical orifice, said tube having a screen with a mesh size such that the metal alloy powder cannot be drawn into the tube when the cavity is evacuated.

7. The apparatus of claim 1, wherein the upper member and the lower member comprise an upper platen and a lower platen, respectively, and wherein the pressing surfaces are located parallel to one another.

8. The apparatus of claim 1, wherein the means for sealably joining said means for pressing and said means for separating comprises a weld extending around and joining the periphery of the upper pressing member, the lower pressing member and said means for separating.

9. The apparatus of claim 1, further comprising a means for conforming said means for inhibiting interdiffusion to the pressing surfaces to which it is attached, said means for conforming comprising an air passageway that is interconnected with the cavity and said means for evacuating such that both said means for conforming and the cavity may be evacuated through said means for evacuating, wherein evacuation of the air passageway causes the upper metal foil to conform to the upper pressing surface and the lower metal foil to conform to the lower pressing surface.

10. The apparatus of claim 9, wherein the means for conforming comprises an air passageway between said means for inhibiting interdiffusion and the pressing surfaces.

11. The apparatus of claim 9, further comprising an upper screen and a lower screen said upper screen located intermediate the upper metal foil and the pressing surface of the lower pressing member, said lower screen located intermediate the lower metal foil and the pressing surface of the lower pressing member, said upper and lower screens each having a mesh size, wherein the mesh size as sufficiently small to prevent powder particles which are to be inserted into the cavity from entering the means for conforming.

12. An apparatus for forming a metal alloy foil, comprising:

means for pressing a metal alloy powder, comprising an upper pressing member and a lower pressing member, each having a pressing surface, said pressing surfaces positioned opposite one another;

means for separating in touching contact with the pressing surfaces, said means for separating and the pressing surfaces together defining a cavity having a near-net shape of a foil;

means for sealably joining said means for pressing and said means for separating;

means for evacuating the cavity, said means integrally formed into the means for pressing; and means for inhibiting interdiffusion comprising an upper two-layer metal foil and a lower two-layer metal foil attached to the pressing surfaces of the upper pressing member and the lower pressing member, respectively.

13. The apparatus of claim 12, wherein the upper and lower two-layer foils each comprise two layers of metal foil separated by a de-bonding agent.

14. The apparatus of claim 13, wherein the metal foils comprise molybdenum and the de-bonding agent comprises magnesium hydroxide.

15. The apparatus of claim 12, further comprising a means for conforming the upper two-layer metal foil and the lower two-layer metal foil to the pressing surfaces to which they are attached.

16. The apparatus of claim 15, wherein the means for conforming comprises air passageways between the upper two-layer metal foil and the upper pressing surface and the lower two-layer metal foil and the lower pressing surface.

17. The apparatus of claim 15, further comprising an upper screen and a lower screen, said upper screen located intermediate the upper two-layer metal foil and the pressing surface of the upper pressing member, said lower screen located intermediate said lower two-layer metal foil and the pressing surface of the lower pressing member, said upper and lower screens each having a mesh size, wherein the mesh size is sufficiently small to prevent powder particles which are to be inserted into the cavity from entering the means for conforming.

18. The apparatus of claim 12, wherein the means for evacuating comprises a cylindrical orifice formed from two opposing hemi-cylindrical shapes, one each formed on an opposing edge of upper pressing member and lower pressing member, respectively, and a tube inserted and sealed into the cylindrical orifice, said tube having a screen with a mesh size, wherein the mesh size is sufficiently small to prevent powder particles which are to be inserted into the cavity from being drawn into the tube when the cavity is evacuated.

19. The apparatus of claim 12, wherein the upper member and the lower member comprise an upper platen and a lower platen, respectively, and wherein the pressing surfaces are located parallel to one another.

20. The apparatus of claim 12, wherein the means for sealably joining said means for pressing and said means for separating comprises a weld extending around and joining the periphery of the upper pressing member, the lower pressing member and said means for separating.

* * * * *